United States Patent [19]

Mayer et al.

[11] Patent Number: 4,571,206

[45] Date of Patent: Feb. 18, 1986

[54] ACTION FIGURE WITH WING MOVEMENT DERIVED FROM LEG MOVEMENT

[75] Inventors: John F. Mayer, Fort Thomas, Ky.; Stuart A. Cook, New Richmond; Harvey G. Springer, Cincinnati, both of Ohio; Earl M. Wood, Jr., Newport, Ky.

[73] Assignee: CPG Products Corp., Minneapolis, Minn.

[21] Appl. No.: 574,827

[22] Filed: Jan. 30, 1984

[51] Int. Cl.[4] ..... A63H 3/20; A63H 13/02

[52] U.S. Cl. ..... 446/330; 446/336; 446/379; 446/383

[58] Field of Search ..... 446/317, 330, 331, 333–337, 446/339, 340, 351–359, 365, 366, 381, 383, 390

[56] References Cited

U.S. PATENT DOCUMENTS

| | | | |
|---|---|---|---|
| 1,210,266 | 12/1916 | Bickelhaupt | 446/330 |
| 1,521,855 | 1/1925 | Baty et al. | 446/330 X |
| 1,619,630 | 3/1927 | Pajeau | 446/366 |
| 1,645,228 | 10/1927 | Christiansen | 446/330 |
| 1,800,775 | 4/1931 | Bostwick | 446/379 |
| 2,560,481 | 7/1951 | Rouse | 446/331 |
| 2,637,937 | 5/1953 | Polk | 446/365 |
| 2,637,940 | 5/1953 | Fugitt | 446/359 |
| 2,724,926 | 11/1955 | Fisher | 446/353 |
| 2,846,811 | 8/1958 | Polk | 446/365 |
| 4,244,138 | 1/1981 | Holahan et al. | 446/365 |

FOREIGN PATENT DOCUMENTS

| | | | |
|---|---|---|---|
| 1014211 | 5/1952 | France | 446/352 |

*Primary Examiner*—F. Barry Shay

*Attorney, Agent, or Firm*—Gene O. Enockson; L. MeRoy Lillehaugen; Stuart R. Peterson

[57] ABSTRACT

The toy action figure includes a torso having a pair of pivotally mounted wings and a pair of legs, the legs being mounted to the torso for both pivotal and rocking movement. A pair of actuating mechanisms within the torso convert the rocking movement to a pivotal movement so that the wings are moved in a flapping manner. A spring returns the legs and wings to their normal or unactuated positions whenever the child stops pressing the legs together.

7 Claims, 9 Drawing Figures

ACTION FIGURE WITH WING MOVEMENT DERIVED FROM LEG MOVEMENT

FIELD OF THE INVENTION

This invention relates generally to a winged toy figure, and pertains more particularly to such a figure in which a pinching-like movement of the figure's legs causes a flapping movement of the figure's wings.

SUMMARY OF THE INVENTION

An object of the present invention is to provide a unique figure provided with wings at the back thereof which are caused to flap by pinching or squeezing the figure's legs together. In this regard, it is planned that the manual leg actuation be quite simple and readily achieved by relatively young children.

Another object of the invention is to provide a figure having wings at the back thereof which are moved by manually actuating the figure's legs, the motion being transmitted from the legs to the wings by means completely contained within the torso or body of the figure. Even though pivotally mounted wings are employed, it is an aim of the invention to provide an action figure that otherwise has a general resemblance to a human being. In this regard, it is intended that the figure be devoid of any special actuating members on its exterior which would detract from the figure's overall appearance and also render the figure more difficult to operate.

Still further, it is an object of the invention to provide actuating means for the wings pivotally attached to a figure which actuating means is simple, rugged and not apt to get out of order readily. An aim of the invention is to provide a toy action figure having wings which can withstand a considerable amount of leg-applied actuating force. In this latter regard, it is planned that leg movement produce the wing movement and that the legs be actuated toward each other so that the application of excessive manual force is limited when the legs contact each other. In this way, the amount of flapping movement of the wings can be correlated and restricted to such a degree that the wings are not forced to pivot to such an extent that they are damaged.

Another object of the invention is to provide an actuating means for a winged figure that is sufficiently compact so that the figure itself can be made quite small when it is desired to miniaturize the overall size of the figure. In this regard, an aim of the invention is to keep the limbs usually associated with a human body in proper proportion to each other and to the figure's torso, and at the same time have adequate space within the torso for the actuating means that pivotally moves or causes flapping of the wings in response to a manual movement of the figure's legs.

It is also an object of the invention to provide a winged figure that can be inexpensively manufactured.

Another object of the invention is to provide a toy figure that will have considerable appeal to children in that the wings, especially their flapping capability, provide a certain degree of mystique that the child relishes.

Yet another object of the invention, which is somewhat allied with the preceding object, is to provide a figure, while somewhat grotesque in that it includes both human-like and bird-like features, nonetheless can be in a form resembling a fictitious comic strip character.

Briefly, the present invention contemplates an action figure having pivotally mounted wings at the rear thereof which are caused to flap by reason of the squeezing or pinching together of the figure's legs, the leg movement being transmitted to the wings by components or parts contained completely within the figure's torso. While the pinching together of the figure's legs causes wing movement in one direction, a spring, also within the figure's torso, returns the wings and the legs to their normal or unactuated positions.

DESCRIPTION OF THE PREFERRED EMBODIMENT

Figure 1:
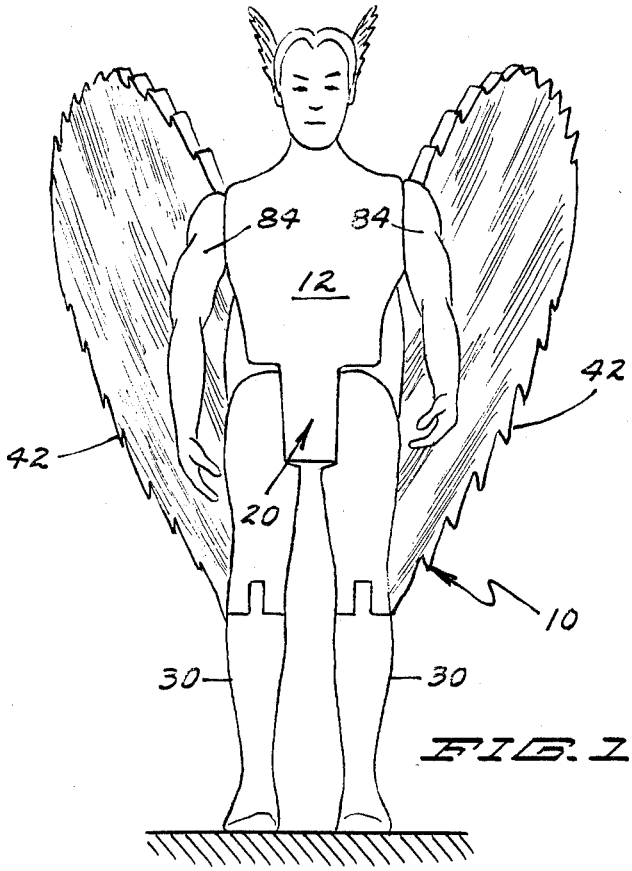
FIG. 1 is a front view of a winged action figure exemplifying our invention, the view illustrating the figure in an unactuated condition.
Figure 2:
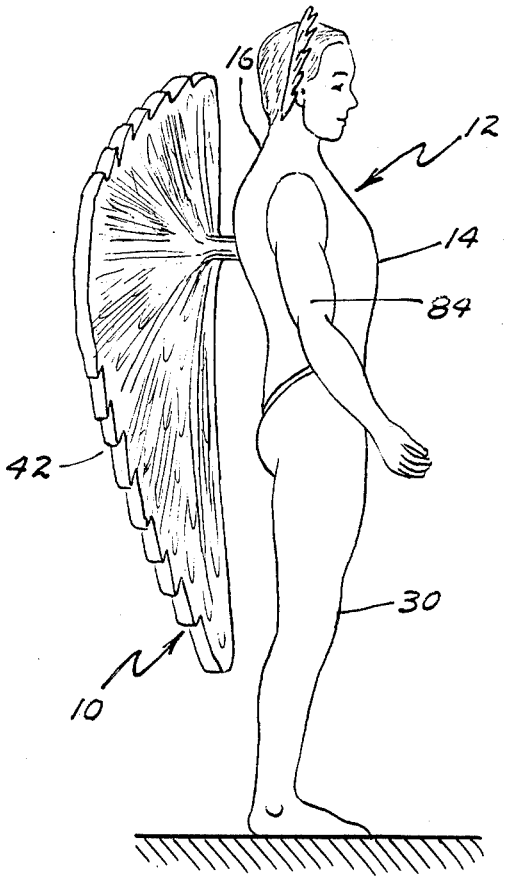
FIG. 2 is a side view of FIG. 1.

The toy figure exemplifying the invention in this instance has been indicated generally by the reference numeral 10. The figure includes a hollow torso 12 comprised of a front plastic shell 14 and a rear plastic shell 16; the shells 14, 16 are suitably secured together along a line 18 appearing in FIG. 5.

Figure 4:
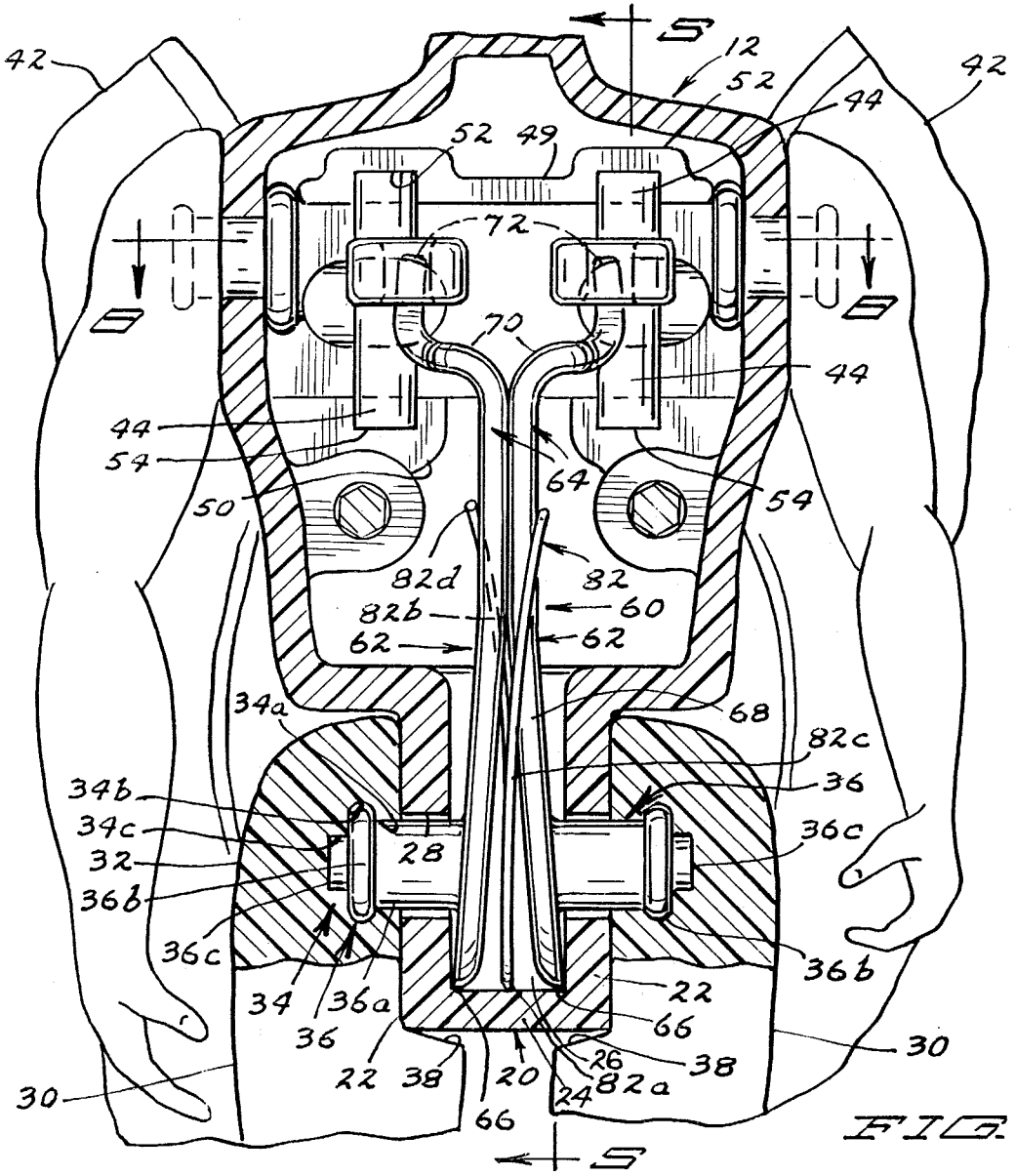
FIG. 4 is a vertical sectional view taken generally through the shoulder joints of FIG. 2.
Figure 7:
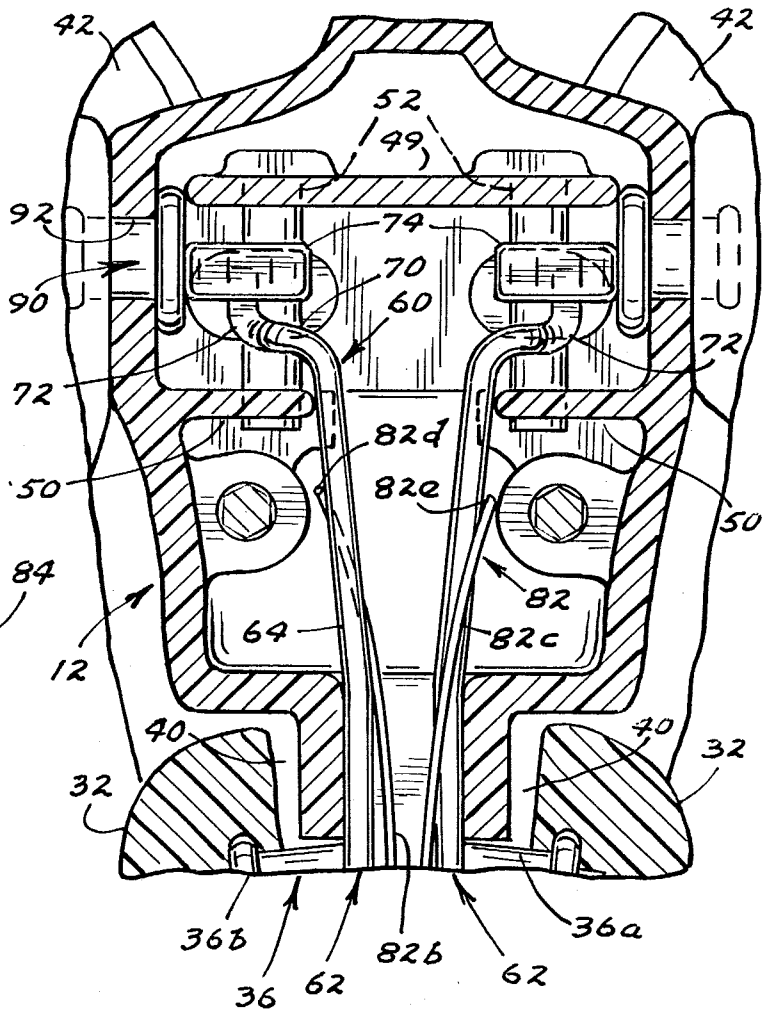
FIG. 7 is a sectional view taken in the direction of line 7—7 of FIG. 5.
Figure 6:
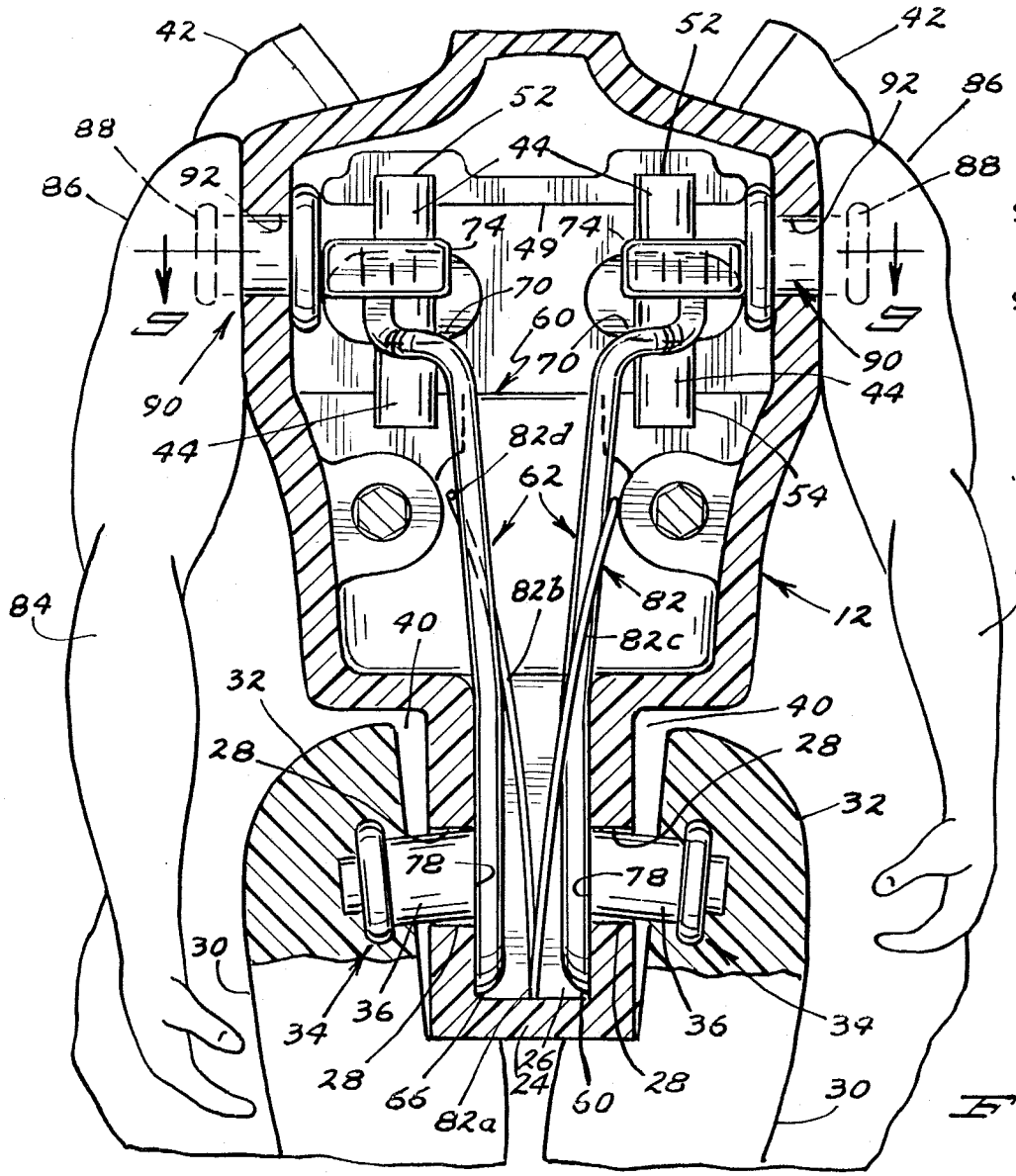
FIG. 6 is a sectional view corresponding to FIG. 4 but illustrating the figure's legs after they have been pressed together to produce a wing movement.

The lower portion of the torso 12 is U-shaped, this portion having been designated by the reference numeral 20. More specifically, as can be seen in FIGS. 4 and 6, the portion 20 includes parallel side walls 22 having a horizontal base or bight portion 24. The parallel side walls 22 and the horizontal base 24 form a rectangular notch 26. Each side wall 22 has a circular opening 28 formed therein.

The toy action FIG. 10 includes a pair of legs 30, each leg 30 having a hip 32 in which is formed a socket 34 which includes a cylindrical bore **34*a*, an annular groove 34*b* and a counterbore 34*c*. Each leg 30 has a leg mounting unit denoted generally by the reference numeral 36; the unit 36, in each instance, includes a sleeve or cylindrical portion 36*a*, a circumferential rib 36*b* and a cylindrical tip 36*c*. The leg mounting units 36 are press fitted into the sockets 34, the sleeve or cylindrical portions 36*a* being received in the bores 34*a*, the circumferential ribs 36*b* in the annular grooves 34*b* and the cylindrical tips 36*c* in the counterbores 34*c*. The press fit is not sufficient to prevent each leg 30** from being independently pivoted forwardly or rearwardly by the child.

The circular opening 28 at each side has a diameter somewhat larger than the cylindrical portion **36*a* of the particular leg mounting unit 36 in order that the leg mounting unit 36 projecting therethrough can rock within the circular opening 28, as can be understood by comparing the rocked condition of the two leg units 36 appearing in FIG. 6 with the position of these two leg mounting units 36 in FIG. 4. Also, it is to be observed that a sloping edge is formed at 38 that permits the rocking of the legs 30 from the position in which they appear in FIG. 4 to that in which they appear in FIG. 6. It can also be pointed out at this time that a gap is formed at 40 in FIG. 6 when the two legs 30 are pressed toward each other, the sloping edge 38 under these conditions moving closer to the underside of the torso's U-shaped bottom portion 20**.

The salient feature of the present invention involves the use of a pair of wings 42 that are mounted for pivotal movement in order to simulate a wing-flapping action. To achieve the pivoting of the wings 42, each wing 42 has a pin 44 and a short arm 46 extending rearwardly therefrom to provide an integral connection with the wing 42 that that particular arm 46 is to move. The arms 46 are free to move within laterally spaced horizontal slots 48 formed in the backside of the rear shell 16.

Figure 5:
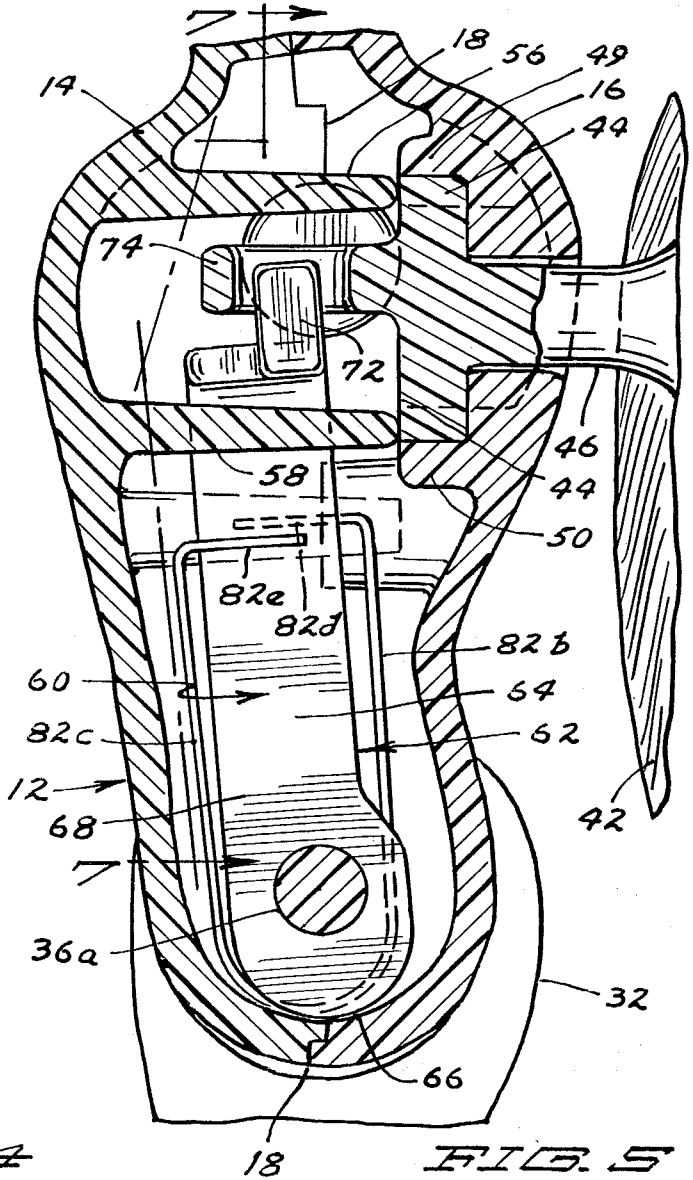
FIG. 5 is a sectional view taken in the direction of line 5—5 of FIG. 4.

As best viewed in FIG. 5, the rear shell 16 is formed with integral upper and lower ledges 49 and 50, respectively, the upper ledge 49 having a pair of laterally spaced recesses 52 in its forward edge and the lower ledge 50 having a pair of laterally spaced recesses 54 in its forward edge, the recesses 52, 54 being vertically aligned. It can also be seen from FIG. 5 that the front shell 14 is formed with upper and lower ledges 56 and 58, respectively, that extend sufficiently rearwardly so that their rear edges maintain the pins 44 captive within the upper recesses 52 and the lower recesses 54, both pairs of recesses 52 and 54 otherwise being open-ended.

The foregoing description has dealt with the pivotal mounting of the wings 42. In order to cause the wings 42 to pivot or flap when the legs 30 are pressed or pinched toward each other, actuating means indicated generally by the reference numeral 60 is employed within the hollow torso 12. More specifically, it is planned that the actuating means 60 be comprised of two separate mechanisms 62, each including a vertically oriented transmission link 64 formed with a rounded bottom 66, a vertical flat shank section 68, a horizontal and outwardly directed upper portion 70, and an upwardly projecting tip 72 having a rectangular cross section, as can be best understood from FIGS. 8 and 9. Each actuating mechanism 62 further includes a forwardly projecting arm 74, the forwardly projecting arm 74 being integral with the particular pin 44 with which it is associated. As can also be best perceived from FIGS. 8 and 9, each arm 74 has a rectangular opening 76 formed therein that encompasses the upwardly directed tip 72.

It has been previously mentioned that each leg mounting unit 36 includes a sleeve or cylindrical portion 36*a*. It is the inner end of each sleeve portion 36*a* that is integral with a lower portion of the outer side of each flat transmission link 64, the juncture of which has been indicated by the reference numeral 78. In practice, the sleeve 36*a* is molded directly to the transmission link 64, more specifically to the lower portion of its flat shank 68.

From the foregoing it will be appreciated that the pins 44 associated with the wings 42 provide laterally spaced vertical axes about which the wings 42 pivot. As previously pointed out, the pair of horizontal slots 48 that are formed in the rear shell 16 allow the arms 46, which project rearwardly from the pins 44, to swing through a sufficient angle so as to simulate a wing-flapping movement.

Whereas the actuating means 60 comprised of the two mechanisms 62 cause the wings 42 to pivot and thus resemble a flapping action, this occurring when the legs 30 are pressed or squeezed together, it is planned that a reverse movement be automatically realized through the agency of a generally U-shaped spring 82. From FIG. 5, it will be discerned that the spring 82 includes a curved lower end 82*a*, vertical shank portions 82*b* and 82*c*, as well as horizontal end portions 82*d* and 82*e*. Thus, whenever the child stops pressing the legs 30 toward each other, then the resiliency of the spring 82 acts to return both the legs 30 and the wings 42 to their initial or unactuated position.

Largely for the sake of completion, it will be pointed out that the action FIG. 10 has a pair of arms 84, each having a shoulder 86 containing therein a socket 88. Associated with each arm 84 is an arm mounting unit 90 that has one end portion thereof press fitted into the shoulder socket 88. The arm mounting unit 90 in each instance is free to pivot within a circular opening 92 formed in the torso 12. The arms 84 do not play a role in the practicing of our invention, but, as indicated above, are referred to for the same of completion.

It is intended that the operation of our toy FIG. 10 be extremely simple in order that very small children can actuate the toy. In this regard, all that the child need do is to squeeze together the legs 30. When this is done, the leg mounting units 36 rock in the circular openings 28. It will be recalled that the circular openings 28 are of a sufficient diameter so as to permit the rocking movement to occur. The two actuating mechanisms 62 each include, it will be recalled, a transmission link 64 provided with a rounded bottom 66. It is the rounded bottom 66 that serves as a fulcrum point for the rocking action that is transmitted upwardly through the two links 64 to the forwardly projecting arms 74.

Figure 3:
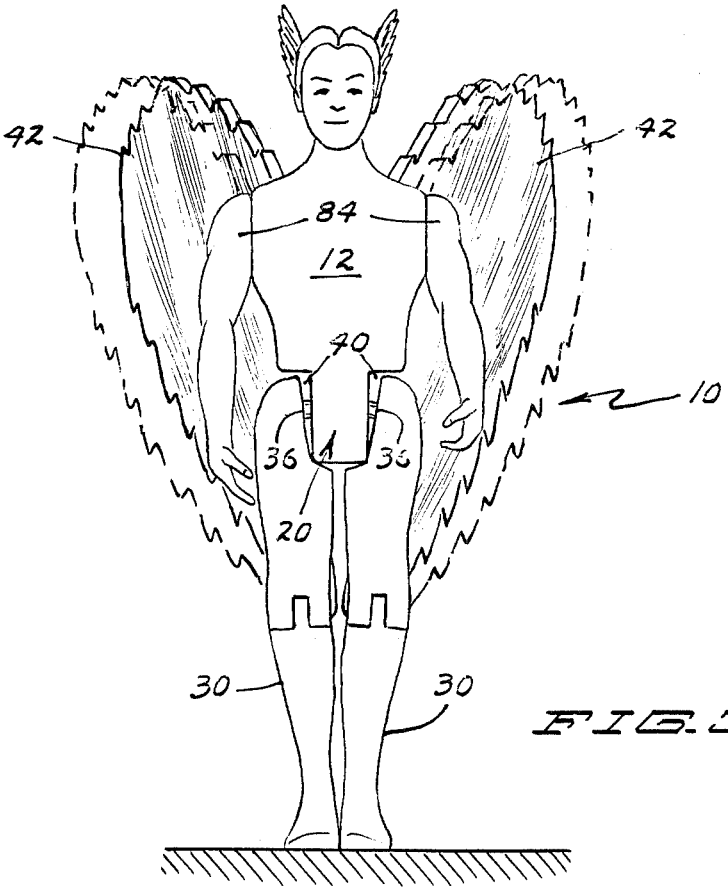
FIG. 3 is a front view corresponding to FIG. 1, but with the legs pressed together so as to produce a flapping of the wings.

FIG. 3, it will be appreciated, represents the squeezed relationship of the legs 30. All that need be done is to compare FIG. 3 with FIG. 1; such a comparison will demonstrate that the legs 30 in FIG. 3 are closer together than in FIG. 1. Portions of the legs 30, although not identified, can engage each other in FIG. 3 to limit the amount of leg rocking. Also, FIG. 6, which corresponds to FIG. 3 in so far as the rocked condition of the legs 30 is concerned, shows that the transmission links 64 of the two mechanisms 62 confront the inner faces of the parallel side walls 22 belonging to the U-shaped bottom portion 20 of the torso 12. Consequently, either the legs 30, by reason of their contacting each other, or the links 64 by reason of portions thereof bearing against the inner surfaces of the side walls 22, prevent any excessive force from being transmitted to the wings 42.

It will be understood that the wings 42 pivot about vertical axes provided by the pins 44. The rearwardly extending arms 46 move angularly within the slots 48 but never strike the inner edges of these slots 48 because of their limited angular movement, either resulting by the engagement of portions of the legs with each other or by the links 64 bearing against the side walls 22 (or both conditions occurring simultaneously).

Figure 8:
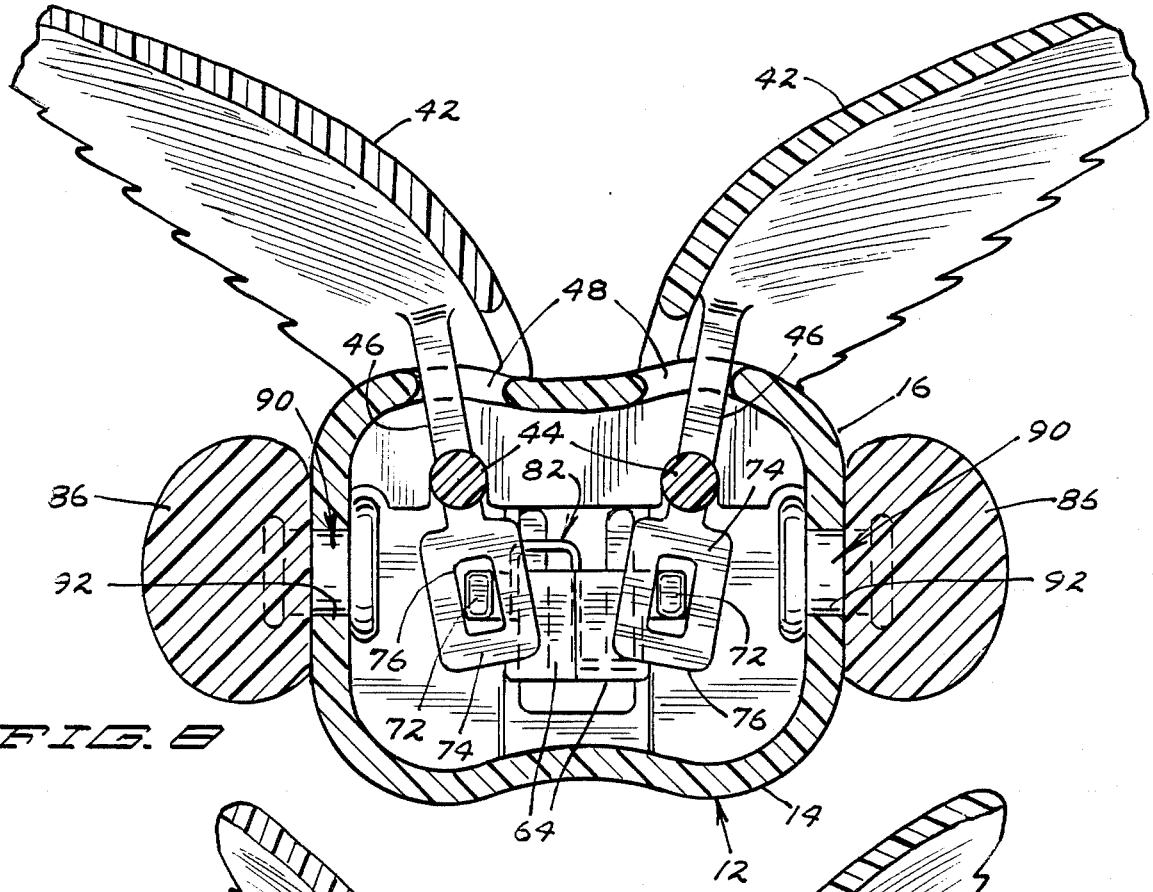
FIG. 8 is a horizontal sectional view taken in the direction of line 8—8 of FIG. 4.
Figure 9:
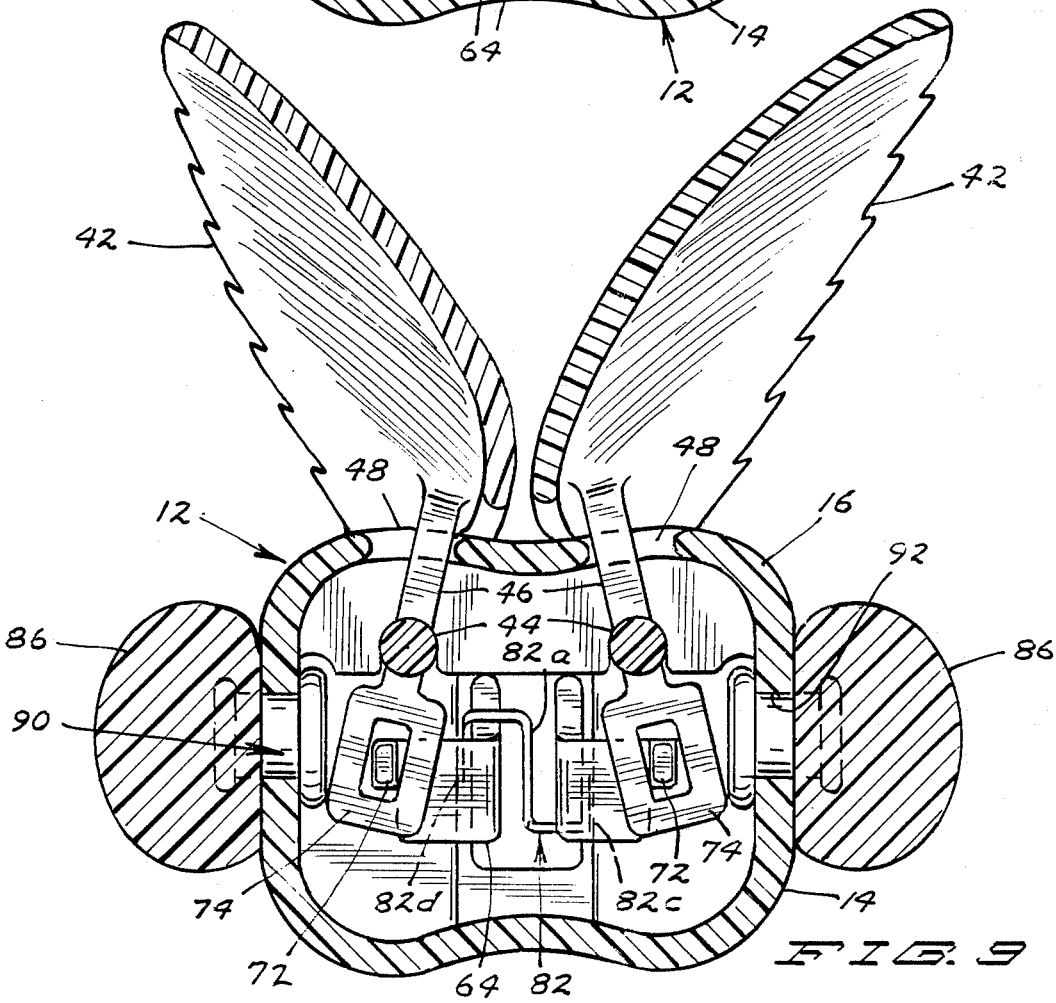
FIG. 9 is a horizontal sectional view taken in the direction of line 9—9 of FIG. 6.

It is the lateral movement of the tips 72 relative to each other, of course, that causes the pivotal movement of the wings 42. In this regard, it will be discerned from FIG. 6 that there is a greater lateral spacing of the pins 44 in this view than in FIG. 4, FIG. 4 depicting the legs 30 prior to being squeezed together to cause a rocking of the links 64. FIGS. 8 and 9 correspond, respectively, to FIGS. 4 and 6; comparison of FIGS. 8 and 9 will also demonstrate that the tips 72 are farther apart in FIG. 9 than in FIG. 8. Inasmuch as the tips 72 extend upwardly into the openings 76 formed in the forwardly projecting arms 74, the tips 72 act against the arms 74 so as to pivot the wings 42 about the axes provided by the pins 44. Consequently, it will be seen, especially from FIGS. 8 and 9, that the wings 42 are pivoted from the more greatly spaced relationship of FIG. 8 into a more closely spaced relationship of FIG. 9.

As soon as the child ceases to exert manual pressure against the legs 30, however, the spring 82 automatically returns the wings 42 from their actuated position in FIG. 9 back to their unactuated position in FIG. 8. Hence, any repeated squeezing of the legs 30 toward each other and successive relaxation of such a pinching-like action will cause the wings 42 to pivot toward each other and away from each other to simulate a flapping action. In other words, a continued manual actuation of the legs 30 will produce first the position of the wings 42 in FIG. 9, then their position in FIG. 8, then an actuation again to the relationship pictured in FIG. 9, then back to the condition illustrated in FIG. 8, and so on. It is the spring 82 that immediately returns the legs 30 and the wings 42 to their unactuated state whenever the child discontinues its manual squeezing or pinching together of the legs 30.

We claim:

1. A toy action figure comprising a hollow torso including a U-shaped bottom forming parallel sidewalls and a horizontal basee, a pair of wings extending from said torso having pins mounted for pivotal movement about laterally spaced axes within said torso and rearwardly extending arms connecting said pins to said wings, a pair of legs extending from said torso mounted for rocking movement relative to the lower portion of said torso, and a pair of actuating mechanisms connecting said legs to said pins so as to convert the rocking movement of said legs to pivotal movement via said pins, each of said actuating mechanisms including an arm extending forwardly from each of said pins and a substantially vertical transmission link within said torso engaged with the forward end of each forwardly extending arm, the lower ends of said links bearing against said horizontal base, respective means securing the lower end portion of each of said links to one of said legs so that when said legs are rocked the rocking action is converted to pivotal movement of the forwardly extending arms, the outwardly facing side portions of said links engaging the inner surfaces of said sidewalls when said legs are rocked sufficiently toward each other, whereby said wings are caused to pivot relative to said torso in a flapping manner.

2. A toy action figure in accordance with claim 1 in which each of said securing means including a leg mounting unit extending outwardly from said torso and each of said legs having a socket into which its said leg mounting unit extends so that each of said legs can be independently pivoted relative to said torso about an axis which is at an angle to the axis of said rocking movement.

3. A toy action figure in accordance with claim 2 including means for limiting the amount of rocking movement of said legs.

4. A toy action figure in accordance with claim 3 in which said limiting means includes a U-shaped bottom portion integral with said torso, the inner side of said U-shaped bottom portion limiting the rocking movement of said legs.

5. A toy action figure in accordance with claim 4 in which the base of said U-shaped bottom portion provides a fulcrum point for the lower end of each of said links.

6. A toy action figure comprising a hollow torso including a front shell and a back shell, said torso having a bottom portion, said back shell having a pair of horizontal slots therein, a pair of wings, a pin for pivotably mounting each wing, each said pin being mounted for pivotal movement within said back shell about a generally vertical axis, a generally horizontal arm projecting rearwardly from each of said pins, said arms extending outwardly through said slots and said wings being mounted on the projecting ends of said arms, a generally horizontal arm projecting forwardly from each of said pins, each of said forwardly projecting arms having a rectangular opening therein, a transmission link for each wing including a generally vertical shank having a tip at its upper end, the tips, extending into said rectangular openings with a loose fit therein, the lower end of each shank being supported on the bottom portion of said torso and said bottom portion providing a fulcrum point for rocking action of each transmission link, a leg-mounting unit attached to each of said shanks adjacent the lower end thereof and extending outwardly from said torso, and a leg pivotably attached to each of said leg-mounting units, said legs extending from said torso in mutually spaced relation, said torso bottom, leg mounting units and legs being constructed and arranged so that, when manual pressure is applied to said legs to move said legs closer together, said transmission links are rocked to space said tips further apart, the spacing of said tips farther apart causing said wings to pivot closer together.

7. A toy action figure in accordance with claim 6 in which said rear shell is formed with upper and lower ledges, each ledge having a pair of laterally spaced open ended recesses therein in which said pins are received, and said front shell being formed with upper and lower ledges for closing said recesses to maintain said pins captive, but rotatable, within said recesses.

* * * * *